United States Patent [19]

Switlik

[11] Patent Number: 4,894,036

[45] Date of Patent: Jan. 16, 1990

[54] INFLATOR ASSEMBLY FOR LIFE VESTS

[75] Inventor: Stanley Switlik, Pennington, N.J.

[73] Assignee: Switlik Parachute Company, Inc., Trenton, N.J.

[21] Appl. No.: 229,400

[22] Filed: Aug. 8, 1988

[51] Int. Cl.[4] ..... B63C 9/16

[52] U.S. Cl. ..... 441/93; 441/94

[58] Field of Search ..... 441/92, 93, 94; 222/3, 222/5

[56] References Cited

U.S. PATENT DOCUMENTS

| | | | |
|---|---|---|---|
| 2,463,641 | 3/1949 | Podell | 441/93 |
| 3,059,814 | 10/1962 | Poncel et al. | 441/94 |
| 3,266,668 | 8/1966 | Davis | 441/94 |

*Primary Examiner*—Sherman D. Basinger
*Assistant Examiner*—Stephen P. Avila
*Attorney, Agent, or Firm*—Sperry, Zoda & Kane

[57] ABSTRACT

Disclosed is an inflator assembly for life vests which includes a one-piece housing heat sealed to the wall of an associated cell of the vest. Exteriorly of the cell, the housing has an end-to-end bore, in one end of which a carbon dioxide cartridge is mounted, in position to be pierced by a plunger slidable within the bore. The bore is stepped to form communicating chambers. Normally the plunger is in a position in which O-rings thereon sealably engage the walls of both chambers, at opposite sides of a port through which the gases are to flow into the cell when the cartridge is pierced. Springs within the respective chambers exert their force in opposite directions. A lever handle has a cam surface, such that when the handle is thrown the cam surface will act upon the springs to bias the plunger to a cartridge-piercing position. Further movement of the handle permits the other spring to partially withdraw the plunger. With the handle cammed to a final position, the escaping gases now bias the plunger to a position in which both O-rings clear the port, for inflating the cell, after which the force exerted by one of the springs returns the plunger to its initial position to prevent backflow of the gases. The construction has the advantage of permitting initial assembly, installation, and full testing, even with the device heat sealed to the vest.

15 Claims, 2 Drawing Sheets

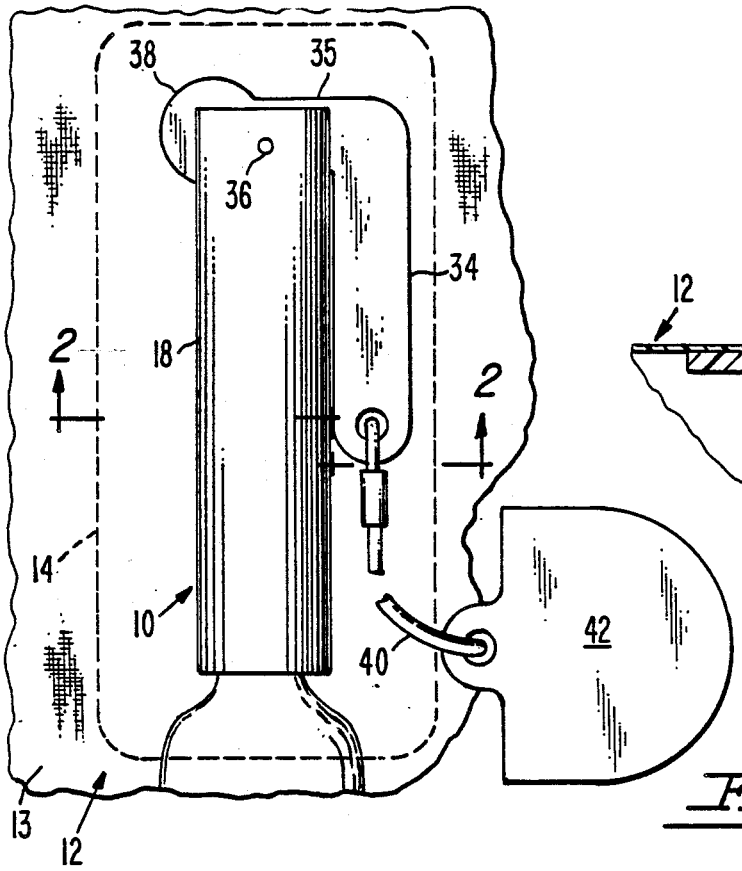
Fig. 1
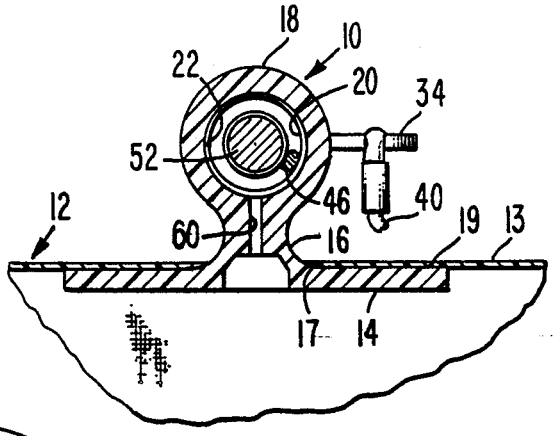
Fig. 2
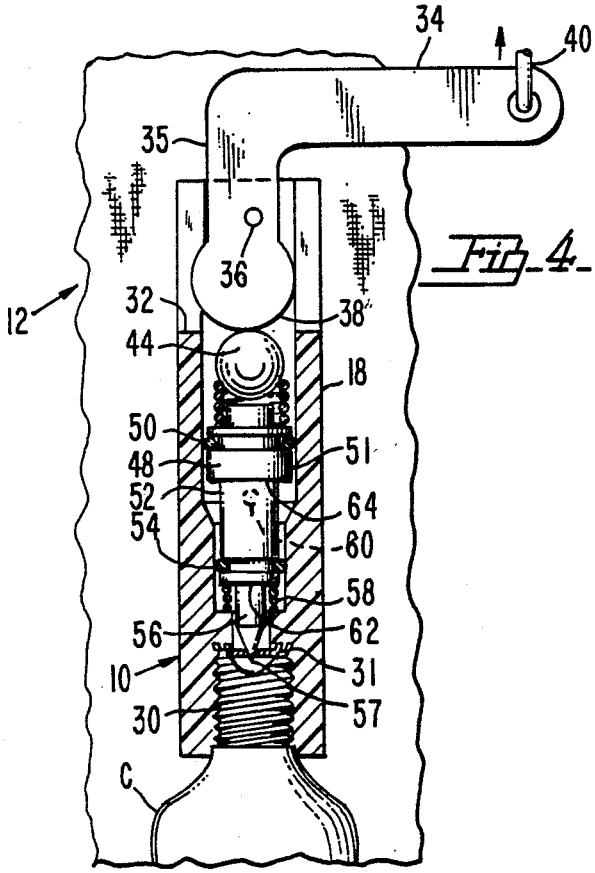
Fig. 4
Fig. 3
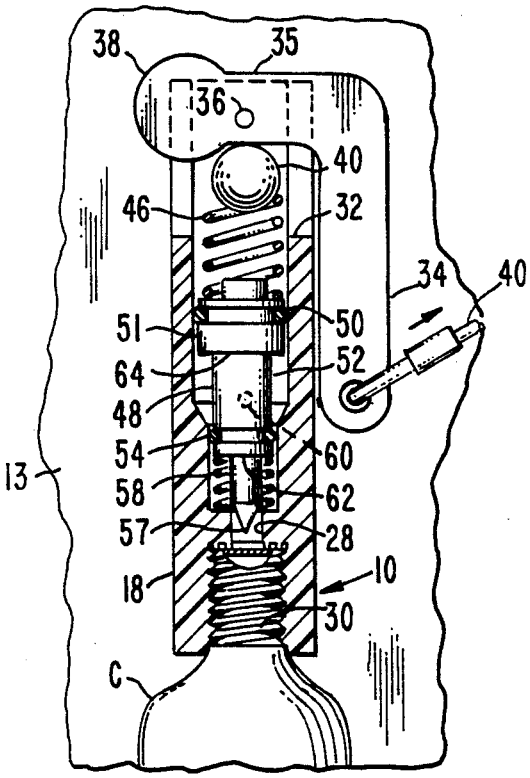

INFLATOR ASSEMBLY FOR LIFE VESTS

BACKGROUND OF THE INVENTION

1. Field Of The Invention

The present invention relates, in a very general sense, to check valves. More particularly, however, the invention relates to inflator assemblies for life vests of the single or dual flotation cell type. Life vests of this type are used, for example, by commercial airlines, and commonly, each cell has its own inflator assembly. The inflator assembly includes check valve means, so designed that when it is necessary to inflate the vest, the wearer pulls upon a lanyard, operating the inflator assembly in such a way as to pierce a carbon dioxide cartridge attached thereto. Escape and consequent expansion of the gas confined within the cartridge is effective to inflate the associated cell.

2. Description Of The Prior Art

Inflation devices for life vests of the character described require means for attaching the same to the wall of the associated, inflatable cell. Heretofore, one conventional procedure has been to use a mechanical connection, involving threaded elements, nuts, and the like, to clamp the material of the life vest, together with gasket means, between components of the inflator assembly, or more typically, to seal a valve stem with air check to the cell, and then mechanically attach the inflator to the valve stem via a threaded nut and washer.

In devices of this type, governmental regulations must be complied with, with respect to extensive testing procedures to assure reliable operation in the event of an emergency, the prevention of back leakage through the inflator assembly, the leakproof mounting of carbon dioxide cartridges, and the carrying out of other important safety measures.

If a procedure such as heat sealing were used to mount the inflator assembly upon the fabric of the life vest, the attachment would become a permanent one. As a result, should it be necessary to replace the inflator assembly due to the inability thereof to pass certain safety tests, a high expense would result. Conversely, when a mechanical mounting is used, the failure of the device to pass certain tests may permit the device to be removed in its entirety from the cell of the life vest for replacement in whole or in part and for re-testing, but the overall expense is increased due to the inability to utilize heat sealing, as well as the added materials and labor of assembly.

Heretofore, so far as is known, there have been no devices which have been so designed as to facilitate the carrying out of all presently required test procedures, the replacement or repair of any one or more elements of the device, the initial, inexpensive assembly of the device, and the inexpensive installation thereof by heat sealing. The present invention has as its main purpose the overcoming of all of these shortcomings found in inflator assemblies heretofore designed.

SUMMARY OF THE INVENTION

Summarized briefly, the present invention incorporates a one-piece, molded housing of a suitable plastic material adapted to be heat sealed to the material of a modern day life vest such as is used by commercial airlines under government supervision. The housing includes a mounting flange interfacing with the life vest material to permit the heat sealing of the inflator assembly to the vest, a base, and a body having an end-to-end bore. Mounted in the bore is a pivoted handle adapted to be thrown by a pull upon a lanyard. The handle includes a cam surface within the bore, and the cam surface engages a floating spring seat, in particular a ball that engages the base of a first spring coiled about a slidable plunger. The plunger has a piercing tip, so that when urged in one direction it will pierce the end of a carbon dioxide cartridge that is attached to the housing in a position closing the end of the bore remote from the handle. A second spring is also mounted in the bore, receiving the plunger. The plunger has spaced O-rings in leak-preventive contact with the wall of the bore, the O-rings normally being at opposite sides of a port through which gases escaping from the carbon dioxide cartridge will flow into the cell for inflating the same.

The springs are so designed that when the device is in a standby condition, the spring forces are balanced, so that the plunger is not biased in either direction, and is at rest in a position in which the O-rings are located at opposite sides of the port. When, however, the handle is thrown, the movement of the cam surface to a position in which it exerts its maximum cam effect causes the cam to bias the ball into engagement with the plunger, so that there is a direct contact of cam-with-ball and ball-with-plunger, that is to say, there is a direct line of force to cam to ball to plunger effective to bias the plunger to a cartridge-piercing position. Then, further movement of the handle responsive to the continuing pull on the lanyard presents a lower cam surface to the ball, permitting the first spring to cam the handle to its final, fully thrown position and expanding the first spring to an extent sufficient to allow the second spring to exert its own force, to withdraw the tip of the plunger slightly from the cartridge. This frees the confined gases for escape and expansion. The escaping gas exerts a force against the plunger tending to bias it away from the cartridge a distance effective to compress the back spring to an extent that will cause both O-rings to clear the outlet port, allowing the gas to flow into the cell. When the force of the escaping gas is spent, the springs are once again both permitted to return to a balanced condition, with the rear spring urging the plunger forward to re-seat the front O-ring. Thus, the plunger is returned to a static position matching or nearly matching its original position, wherein the O-rings are located at opposite sides of the port once again, to prevent back leakage from the cell through the inflator assembly.

This arrangement is the structural feature that permits the unit to be heat-sealed to a life vest, in a permanently sealed mounting that does not require an air check as a separate item.

The arrangement also has a desirable advantage in locating all components of the device where they can be easily accessed, and this in turn permits ready replacement, repair, or substitution, of one or more of the interior components of the check valve assembly. Further, this permits all testing procedures to be carried out even with the device heat sealed to the fabric of the life vest. The housing of the device can remain attached to the life vest, with all interior components being readily accessible in the event of a test failure. Further, the construction permits equally swift assembly of the relatively few parts of the entire device, and inexpensive, fast installation thereof.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

FIG. 1 is a top plan view showing an inflator assembly constructed in accordance with the invention, a life vest cell on which the device is mounted being illustrated fragmentarily and a gas cartridge and lanyard means also being illustrated fragmentarily;

FIG. 2 is a transverse sectional view, substantially on line 2—2 of FIG. 1;

FIG. 3 is a longitudinal sectional view through the inflator assembly, taken substantially on line 3—3 of FIG. 2;

FIG. 4 is a view on the same cutting plane as FIG. 3, in which the handle has been moved from the rest position shown in FIG. 3 to a position effective to cause piercing of the cartridge;

DETAILED DESCRIPTION OF THE PREFERRED EMBODIMENT

Figure 5:
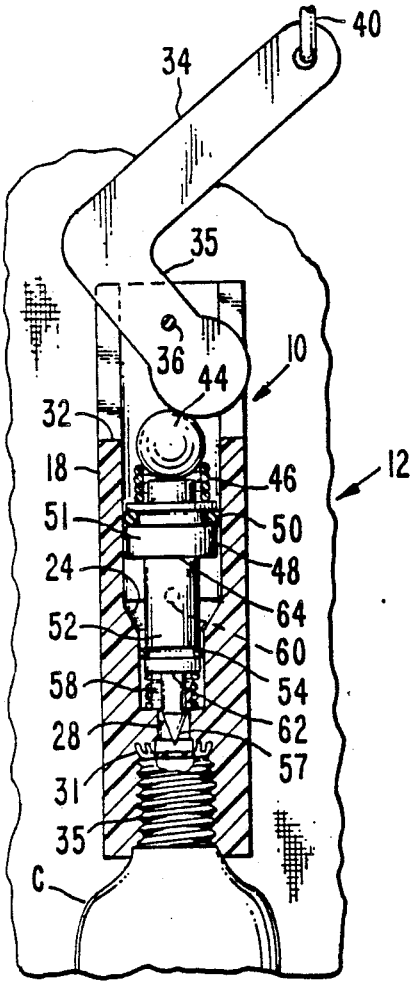
FIG. 5 is a view similar to FIG. 3 in which the handle has been moved still further responsive to a pull on the lanyard, to a position in which the first spring begins to cam the handle to its final position, and the second spring asserts its force enough to partially withdraw the plunger after the cartridge has been pierced.

The inflator assembly 10 comprising the present invention is a component of an inflatable life vest 12 having one or more cells 13 receiving a flat, oblong mounting flange 14 formed on the underside of and integrally with an elongated base 16 projecting upwardly through and fitting snugly within a correspondingly shaped opening 17 formed in the wall of cell 13. Integral with base 16 is an elongated cylindrical body 18. The flange, base, and body comprise a single piece of rigid plastic material. The upper surface of the flange underlies the wall of cell 13 in contact therewith, and is heat sealed thereto as at 19, over the entire area of its interface with the wall of the cell. In and of itself, heat sealing a mounting flange to the cell wall is well known as shown, for example, in Moran Pat. No. 3,512,807, the disclosure of which is incorporated herein by reference.

A bore 20, open at both ends, extends end-to-end of body 18 and comprises (FIG. 3) an elongated first spring chamber 22 the inner end of which terminates in a frusto-conical shoulder 24 which steps down the bore diameter to a second spring chamber 26 communicating with a flow passage 28 of still smaller diameter. Passage 28 merges into a threaded counter bore 30 in the inner end of which is an annular, grooved sealing flange 31 molded integrally with the body 18 and sealably engaged with the mating, threaded neck of a carbon dioxide cartridge C. The cartridge is per se conventional, and is of the type having a normally sealed end adapted to be pierced to release its contents.

Figure 6:
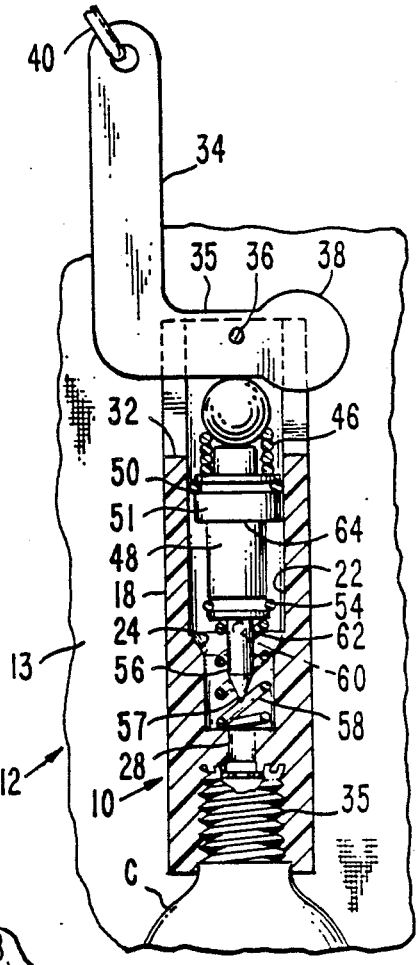
FIG. 6 is a view similar to FIG. 3 in which the handle has been cammed to its final position, permitting the escaping gases to bias the plunger to a position in which the gases can pass through the port into the cell to be inflated.
Figure 7:
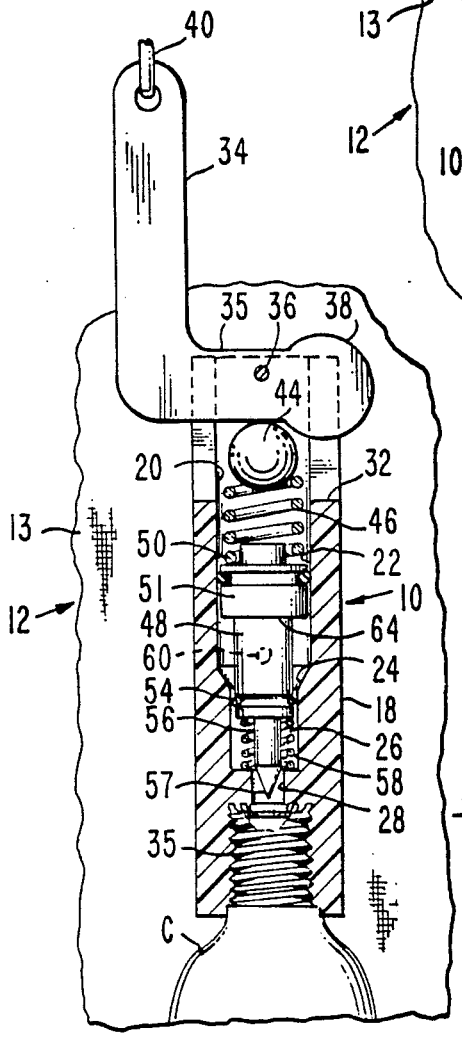
FIG. 7 is a view similar to FIG. 3 in which the handle remains in its final operating position, and the force of the escaping gases has been fully spent, permitting the rear spring means to re-assert a force sufficient to return the plunger to its initial position, preventing back leakage from the inflated cell.

At the end thereof remote from the cartridge, body 18 is formed with a slot 32 intersecting chamber 22 in communication therewith for mounting of an elongated, flat, right-angular operating handle 34 having one leg normally disposed exteriorly of body 18, and having a shorter, inner leg 35 through which extends a transverse pivot pin 36 mounting the handle for swinging movement between its initial, rest position shown in FIG. 3 to its opposite extreme position shown in FIGS. 6 and 7, to which it is thrown when the life vest is to be inflated.

Formed upon the distal end of leg 35 is a circularly shaped cam 38 eccentric to pin 36. At the opposite end of the handle, that is, the distal end of the elongated outer leg thereof, a lanyard 40 is attached, connected to a pull tab 42.

Leg 35 of the handle bears against a ball 44 providing a movable seat for a main spring 46 interposed between the ball and the rear end of an elongated, one-piece plunger 48 having a circular mounting groove for a first O-ring 50 adjacent the end against which the main spring 46 bears. Forwardly of O-ring 50, the rear portion 51 of the plunger is of a diameter adapted to give it a free sliding fit within the main spring chamber 22. Forwardly of the portion 51, plunger 48 is stepped down in diameter to provide an intermediate portion 52 the diameter of which gives it a free sliding fit within the second spring chamber 26. Formed in intermediate portion 52 is a groove for an O-ring 54. Forwardly of the O-ring 54, plunger 48 is still further stepped down in diameter to provide a forward portion 56 terminating in a piercing tip 57. The O-rings provide seals between the plunger and the walls of the respective spring chambers.

Extending about tip portion 56, and compressible between the intermediate portion 52 and the forward end of chamber 26, is a second spring 58.

Providing means for flow of the expanding gases released by piercing of the cartridge C, is a port 60 of oblong cross-section, extending from the main chamber 22 immediately rearward of the shoulder 24, and opening upon the interior of cell 13 when the inflator assembly is mounted as shown.

Assembly And Testing

An important feature of the invention is the fact that it is heat-sealed to the cell . The body, base, and mounting flange comprise a one-piece housing for all of the remaining components, and this housing is especially designed to permit its attachment to the associated cell by heat sealing.

Devices of this type, being designed for use especially in life vests carried as equipment on commercial airlines, are subject to heavy governmental regulation, with respect to testing procedures. These requirements have militated against certain desirable assembly and mounting techniques, as for example, the use of heat sealing as a means for mounting the assembly upon the material of the life vest proper. Because of a high rate of failure under the stringent testing procedures imposed, it is often necessary to completely disassemble the valve mechanism from the associated components of the housing and mounting means. If a device were heat sealed, and then tested, and if it should happen that the device were to fail in the test, it becomes impossible, in devices heretofore designed, to remove and replace the valve mechanism.

In the present device, all of these difficulties are eliminated, so that heat sealing becomes a viable means for mounting the device upon the material of the life vest cell.

For example, since in operation, a cartridge could be loosely mounted, a test for air retention without the carbon dioxide cylinder installed, is always required. This test is what necessitates a separate air check in all other units, and is the reason why there is an O-ring seal on opposite sides of vent port 60 in this device. Also, due to the low pressure seal nature of these air checks and their being prone to leakage it is necessary to service the air check. Checking for this type of leakage is readily permitted in the present device, without removal of the inflator assembly from the cell, since all of the valve components can be readily removed with the inflator assembly mounted in place by removal of the pin 36. This is a very important feature of the present invention, and is what permits it to be sealed directly to the cell. In all other devices, the separate nature of the air check and the need to service the air check require the removal of the inflator from the life vest cell to access the air check for service. This prevents their being permanently sealed directly to the cell.

By the same token, the entire device can be readily subjected to testing before mounting upon the life vest, and further lends itself to full testing after being heat sealed in the manner described above. In each case, should there be a failure, the pin 36 is readily removed and the various components of the valve can be replaced as necessary.

In assembly of the device, it becomes apparent that all that need be done is to insert the plunger, with the spring 56 and the O-rings 50, 54 assembled therewith, after which the spring 46, ball 44, and lever handle 34 are inserted. Insertion of the pin 36 secures the entire assembly in operating position. All testing procedures can be readily carried out, and at the same time, the device can be heat sealed without concern as to the problem heretofore existing, wherein it has been required that a mechanical connection of the inflator assembly to the life vest be employed, utilizing threaded nuts, etc. in the manner shown, for example, in Ruscigno Pat. No. 4,161,797.

In the present instance, in the event of a test failure either before or after heat sealing of the flange to the material of a life vest cell, quick and easy access to all the interior components of the device is had. In this way, the advantages of inexpensive inflator assembly, inexpensive installation, and the use of a minimum number of simply formed components, are all achieved in the one device.

Operation

The operation of the device is shown to particular advantage in FIGS. 3–7.

In FIG. 3, the device is shown as it appears in a rest or standby condition, as it would appear with the life vest stored and awaiting use. At this time, the handle is in one extreme position thereof, with the long, outer leg lying in close proximity to and in parallel relation with the elongated body 18. It may be assumed that all testing procedures have previously been carried out, and that the device has been found in good condition and available for use in an emergency.

At this time, all the parts are in a static condition, that is, springs 46, 58 are in a fully expanded or at least a substantially fully expanded condition. O-rings 50, 54 are disposed at opposite sides of the port 60, in sealable engagement with the walls of chambers 22, 26 respectively.

Assuming the need to inflate the vest, a pull is exerted upon lanyard 40 in the direction shown by the arrow in FIG. 3. Handle 34 swings counter-clockwise when viewed as in FIGS. 3–7, and moves through an angular distance of 90 degrees to the position shown in FIG. 4 during its initial swinging movement. Eccentric or cam 38 is thus caused to present its cam surface to ball 44 so as to bias the ball 44 toward plunger 48, compressing rear spring 46 and bringing ball 44 into direct contact with the plunger. Further camming of the ball toward the cartridge causes piercing thereof by the resultant cam-to-ball-to-plunger direct contact and the advancement of the ball and plunger as a unit. Spring 58 compresses to permit this movement of the plunger, so that tip 57 is now caused to pierce the end of the cartridge C.

In FIG. 5, the handle continues its movement away from its initial position, and as will be seen, the high point of the cam has passed the ball and the ball is now free to move away from the cartridge. With the plunger in the FIG. 5 position, the movement of the ball 44 away from the plunger occurs under the force of spring 46 as he spring 46 expands. The force of the spring 46 is lessened by reason of its expansion and the spring 58 (which was heavily compressed in the FIG. 4 position of the handle) now overcomes the force of spring 46, and exerts sufficient force to withdraw the tip 57 from the end of the cartridge.

It is only necessary that the tip be withdrawn to a very small extent. This alone permits expansion of the gases within the cartridge or cylinder C. The gases, tending to escape, create a strong force directed against the plunger tending to shift the plunger away from the gas cylinder against the restraint of the spring 46. The force of the escaping gases, as the plunger moves to the position shown in FIG. 5, is exerted against shoulder 62 of the plunger, since it is prevented from exiting the chamber 26 at this particular time by reason of the sealable engagement of the O-ring 54 against the wall of that chamber.

Referring to FIG. 6, the continued retraction of the plunger by the force of the escaping gases causes the plunger to move to the FIG. 6 position, wherein the shoulder 62 has entered the larger chamber 22. The instant the O-ring 54 moves out of sealable engagement with the wall of the chamber 26, the continued force of the escaping gases is now exerted against shoulder 64 of the plunger, simultaneously with passage of the gases through port 60 to inflate the cell of the life vest.

The force of the escaping gases, directed against the shoulder 64, will hold the plunger in the FIG. 6 position, against the opposing force of the compressed spring 46, without need of utilizing the force of the second spring 58. Spring 58, indeed, is now fully expanded, and the entire function of holding the plunger in a position where the gases can inflate the cell is assumed by the force of the escaping gases. It should be noted that the forward O-ring must fully clear the port 60, else it could be blown down into the port. This clearance is a function of the full distance that the plunger is biased rearwardly by the force of the escaping gases.

With the cell inflated and the force of the expanding gases having been spent, and with the operating handle 34 moved fully to its final position of FIGS. 6 and 7, the spring 46 is free to expand, and biases the plunger away from the handle as shown in FIG. 7, to cause the O-ring 54 to once again enter the chamber 26 in sealable engagement therewith, while O-ring 50 is in sealable engagement with the wall of chamber 22. This prevents escape of the gases that have inflated the cell, and the life vest is fully inflated and remains so.

The particular size, force, number of coils, and other elements of spring design can be varied. Such designs can be readily calculated by spring design engineers, given the requirement that initially, the springs be allowed to expand to positions in which the plunger will be left in a static or rest condition, with the O-rings 50, 54 at opposite sides of the port 60 and in sealable engagement with the walls of the first and second spring chambers 22, 26 respectively. The design of the springs would further take into consideration the fact that when the handle 34 is thrown to its middle position shown in FIG. 4, the spring 46, must compress enough to allow ball 44 to make direct contact with the plunger and move it forwardly to pierce the cylinder tip, with spring 58 compressing sufficiently not to inhibit the piercing action.

The spring designs should further be sufficient that when the handle 34 is further moved in a direction toward its fully thrown position, as shown in FIG. 5, the spring 56, having been fully or substantially fully compressed when the cartridge was pierced (see FIG. 4) now exerts its full force tending to retract the plunger to withdraw the tip from the hole it made in the end of the cartridge when the cartridge was pierced. Even a slight withdrawal of the tip from the hole in the cartridge permits the sudden expansion of the gases, whereby the plunger is biased to its fully retracted position of FIG. 6, wherein both the front O-ring 54, and the front plunger shoulder against which spring 58 bears, clear the port 60. Combinations of specific springs that will function as so intended are well within the capabilities of skilled spring design engineers, and hence it is not considered necessary in this application to set forth the dimensions and other mechanical characteristics of specific springs which, in combination, will function as intended.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I CLAIM:

1. For use in a life vest of the type having at least one cell inflatable by the expansion of gases escaping from a cartridge in which they have been confined in a compressed condition, an improved inflator assembly comprising:

(a) a housing mountable upon said cell and having a bore in which the cartridge is mountable and a gas exit port communicating the bore with the interior of the cell;

(b) a plunger sliding in the bore and adapted to pierce the cartridge to allow escape and expansion of the confined gases, the bore having communicating first and second spring chambers and the plunger being normally disposed therein in a standby position, the plunger having first and second seal means engaging, in the standby position of the plunger, the walls of the respective chambers at opposite sides of the port;

(c) first and second springs disposed in the first and second chambers respectively, the first spring being tensioned to bias the plunger from its standby position in a direction to pierce the cartridge and the second spring being tensioned to bias the plunger in an opposite direction to at least partially withdraw the same from the cartridge;

(d) a handle pivotally mounted in the housing for movement between standby and final operating positions respectively; and (e) a spring seat interposed between the cam surface and the first spring, said cam surface being adapted, when the handle is moved from its standby position, to shift the spring seat to place the springs under tension and effect direct contact of the spring seat with the plunger to bias the plunger to its cartridge-piercing position, the continued movement of the handle being adapted to lower the cam surface for bias of the plunger by the second spring in its opposite direction, to withdraw it from the pierced cartridge and thereby allow escaping gases to bias the plunger away from the cartridge a distance sufficient for both of said seal means to move fully to one side of the port, thus to permit exit of the gases through the port into the cell for inflating the same, the handle when fully thrown to its final operating position having its cam surface located to allow expansion of both springs to return the plunger to a position in which said seal means are again located at opposite sides of the port and will prevent leakage of said gases from the inflated cell through said bore.

2. An improved inflator assembly as in claim 1 wherein said housing includes means interfaced with said cell in heat sealed engagement therewith.

3. An inflator assembly as in claim 2 wherein the means in heat sealed engagement with the cell comprises a flat mounting flange.

4. An inflator assembly as in claim 3 wherein the housing is formed with a body in which said bore is formed, the life vest having an opening about which the mounting flange extends and the body projecting upwardly through said opening to provide access to said bore.

5. An inflator assembly as in claim 4 wherein said housing is formed wholly from a single piece of molded material.

6. An inflator assembly a in claim 1 in which the first chamber is of greater diameter than the second chamber, and said port is in communication with the first chamber at a location adjacent the second chamber, whereby upon movement of the plunger away from the cartridge under the force of the expanding gases the second sealing means will move wholly out of engagement with the wall of the second chamber to permit flow of the escaping gases through the second chamber into the first chamber and through the port.

7. An inflator assembly as in claim 6 wherein the first and second seal means are in the form of O-rings.

8. An inflator assembly as in claim 7 wherein the bore is formed with a frusto-conical shoulder at the juncture of the first and second chambers, for free passage of the O-ring of the second seal means back into the second chamber upon return of the plunger to its standby condition following inflation of the cell.

9. An inflator assembly as in claim 6 wherein the bore is formed open at both ends, said cartridge being mounted in one end of the bore and the handle being mounted in the other end thereof.

10. An inflator assembly as in claim 9 wherein the cam surface is formed on one extremity of the handle located within said bore.

11. An inflator assembly as in claim 10 wherein the cam surface is in the form of a part-circular enlargement formed upon the end of the handle located within the bore.

12. An inflator assembly as in claim 11 wherein said spring seat is in the form of a ball mounted to float freely within said bore in engagement with the cam surface and said first spring.

13. An inflator assembly as in claim 12 wherein the handle is pinned within its associated end of the bore, whereby on removal of said pin said ball, first and second springs, plunger, and first and second seal means can be removed from the bore through the end thereof in which the handle is mounted.

14. An inflator assembly as in claim 2 wherein the means disposed in heat sealed engagement with the cell is located in contact with a wall of the cell and with the remainder of the housing being disposed fully exteriorly of the cell, said handle being removably mounted in one end of the bore with the cartridge being mounted in the opposite end of the bore and said plunger, spring seat, springs, and seal means being confined between the handle and the cartridge, thereby to permit their ready insertion and removal responsive to attachment and detachment of the handle, thus to facilitate assembly, installation, and testing of the inflator assembly with the housing in heat sealed engagement with the wall of the cell.

15. For use in a life vest of the type having at least one cell inflatable by the expansion of gases escaping from a fixedly positioned conventional gas cartridge in which gas has been confined in a compressed condition, an improved inflator assembly comprising:

(a) a housing being heat sealably mounted to the inflatable cell, said housing defining a bore therein in fluid flow communication with respect to the cell to facilitate inflation thereof;

(b) a plunger means movably mounted within said housing, said plunger means being movable between a piercing position, a filling position and a check valve position, said plunger means including:

(1) a piercing means integral with said plunger means and adapted to selectively pierce the cartridge responsive to movement of said plunger means to the piercing position to release the gases therefrom into the cell for inflation thereof;

(2) a sealing means on said plunger means to define a one-way valving means allowing filling of the inflation cell responsive to said plunger means being in the filling position after piercing of the cartridge and being further responsive to substantial filling of the cell to urge said plunger means to the check valve position for preventing backflow of gases from the inflated cell into said housing, said plunger means, said piercing means, said sealing means and said one-way valving means being completely removable from said housing while allowing maintenance of the heat sealed engagement between the inflated cell and said housing.

* * * * *